US008766540B2

(12) United States Patent
Hamana et al.

(10) Patent No.: US 8,766,540 B2
(45) Date of Patent: Jul. 1, 2014

(54) LIGHTING DEVICE, HEADLAMP LIGHTING DEVICE, AND HEADLAMP UNIT AND VEHICLE HAVING SAME

(75) Inventors: Tetsuya Hamana, Nara (JP); Takashi Kambara, Osaka (JP)

(73) Assignee: Panasonic Corporation, Osaka (JP)

( * ) Notice: Subject to any disclaimer, the term of this patent is extended or adjusted under 35 U.S.C. 154(b) by 139 days.

(21) Appl. No.: 13/559,723

(22) Filed: Jul. 27, 2012

(65) Prior Publication Data

US 2013/0049586 A1 Feb. 28, 2013

(30) Foreign Application Priority Data

Aug. 22, 2011 (JP) ..... 2011-180720

(51) Int. Cl.
*H05B 37/02* (2006.01)

(52) U.S. Cl.
USPC ..... 315/82; 315/247; 315/291; 315/360

(58) Field of Classification Search
CPC ..... H05B 33/008; H05B 33/0812; H05B 33/0815; H05B 33/0818; H05B 33/0821; H05B 33/0851; H05B 33/0884; H05B 33/0893; Y02B 20/341; Y02B 20/345; Y02B 20/346
USPC ..... 315/77, 82, 185 R, 247, 291, 224, 360
See application file for complete search history.

(56) References Cited

U.S. PATENT DOCUMENTS 5,148,087 A 9/1992 Moisin et al.
6,870,328 B2 * 3/2005 Tanabe et al. ..... 315/291
7,345,433 B2 * 3/2008 Bacon et al. ..... 315/291
8,274,237 B2 * 9/2012 Nagase et al. ..... 315/247
8,405,325 B2 * 3/2013 Inoko et al. ..... 315/360
8,575,839 B2 * 11/2013 Inoue et al. ..... 315/82
2005/0082553 A1 4/2005 Yamamoto et al.
2006/0022607 A1 2/2006 Hsu
2010/0156324 A1 6/2010 Nagase et al.
2011/0062870 A1 3/2011 Kanbara
2011/0254462 A1 10/2011 Ruan et al.

FOREIGN PATENT DOCUMENTS

DE 20 2004 004 462 6/2004
EP 1 244 334 9/2002
EP 1 349 433 10/2003

(Continued)

OTHER PUBLICATIONS

European Search Report for corresponding European Application No. 12178772.5-1809 dated Feb. 22, 2013.

(Continued)

*Primary Examiner* — Vibol Tan
(74) *Attorney, Agent, or Firm* — Renner, Otto, Boisselle & Sklar, LLP

(57) ABSTRACT

A lighting device includes: a power conversion unit which converts a direct current (DC) power into a power required by a load; an output current detection unit which detects an output current of the power conversion unit; and a source voltage detection unit which detects a source voltage. Further, the lighting device includes an operation unit which calculates an output current command value so as not to exceed an upper limit of the output current command value set according to a resistance value of an externally connected resistor; and a control unit which controls the power conversion unit such that the output current thereof the power conversion unit becomes the output current command value.

15 Claims, 10 Drawing Sheets

(56) References Cited

FOREIGN PATENT DOCUMENTS

| | | |
|---|---|---|
| EP | 1 659 831 | 5/2006 |
| JP | 2011-113642 | 6/2011 |
| WO | 2008/098617 | 8/2008 |
| WO | 2008/155714 | 12/2008 |

OTHER PUBLICATIONS

Chinese Office Action for corresponding Chinese Application No. 201210278107.3 dated Apr. 29, 2014 and English translation thereof.

* cited by examiner

LIGHTING DEVICE, HEADLAMP LIGHTING DEVICE, AND HEADLAMP UNIT AND VEHICLE HAVING SAME

FIELD OF THE INVENTION

The present invention relates to a lighting device, headlamp lighting device, and headlamp unit and vehicle having the same.

BACKGROUND OF THE INVENTION

Conventionally, there is provided an LED headlamp lighting device for vehicle (see, e.g., Japanese Patent Application Publication No. 2011-113642). The LED headlamp lighting device includes a DC/DC converter which steps up/down a DC voltage supplied from a battery in response to turning on of a LOW beam switch into a DC voltage of a desired voltage value, and a control circuit which controls the on/off of switching elements of the DC/DC converter. The LED headlamp lighting device further includes a power detection circuit to detect a source voltage of the battery and a current detection circuit to detect a current flowing through light emitting diodes (LEDs). The control circuit includes a lamp current command value operation unit and a comparison operation unit.

The lamp current command value operation unit selects a lamp current command value stored in a storage unit in advance based on the source voltage, and outputs it as the lamp current command value. The comparison operation unit compares the lamp current command value outputted from the lamp current command value operation unit with an output current value detected by the current detection circuit, and calculates and outputs an output current command value to make these values equal. Thus, in the LED headlamp lighting device, constant current control can be achieved by controlling the output current command value outputted from the comparison operation unit.

In the LED headlamp lighting device, if the source voltage of the battery is reduced to, e.g., less than 8 V, it begins to decrease the output current. Then, the reduction of output current is performed depending on a change in the source voltage, and control is performed to maintain a rated current if the source voltage is equal to or greater than 8 V. By this control, it is possible to reduce an increase in circuit loss at a low source voltage, and prevent damage to the lighting device.

In the LED headlamp lighting device disclosed in Japanese Patent Application Publication No. 2011-113642, a plurality of LEDs connected in series are used as a load. In this case, there is a variation in luminous flux between the LEDs, and its effect appears prominently when the same forward current flows in each LED. On the other hand, the output current command value is uniquely determined by, e.g., a data table prepared in advance. Accordingly, even if the constant current control is performed using the same output current in multiple lighting devices, the LED brightness is different between the lighting devices or LEDs.

Therefore, in order to set the brightness of each LED in the multiple lighting devices to a predetermined range, it is necessary to select an LED having a luminous flux within a predetermined range. In this case, since the selection process of LEDs is needed to be carried out by a manufacturer of the LEDs, the cost of LEDs increases. The LED brightness cannot be finely controlled to the extent that a user desires.

In order to solve the above-mentioned problems, multiple data tables can be prepared in advance, and a data table can be selected according to the luminous flux of the LED. This eliminates a need for the selection of the LED, thereby suppressing an increase in cost of LEDs. However, in this case, since it requires a memory with a capacity to store the multiple data tables, it may cause an increase in cost.

SUMMARY OF THE INVENTION

In view of the above, the present invention provides a lighting device, headlamp lighting device, and headlamp unit and vehicle having the same, which are capable of adjusting an output current while suppressing an increase in cost, with a simple configuration.

In accordance with a first aspect of the present invention, there is provided a lighting device including: a power conversion unit which converts a direct current (DC) power supplied from a DC power supply into a power required by a load; an output current detection unit which detects an output current of the power conversion unit; and a source voltage detection unit which detects a source voltage of the DC power supply. Further, the lighting device includes an operation unit which, when calculating an output current command value of the power conversion unit based on a voltage value detected by the source voltage detection unit, calculates the output current command value so as not to exceed an upper limit of the output current command value set according to a resistance value of an externally connected resistor; and a control unit which controls the power conversion unit such that the output current of the power conversion unit detected by the output current detection unit becomes the output current command value calculated by the operation unit.

In accordance with a second aspect of the present invention, there is provided a lighting device including: a power conversion unit which converts a DC power supplied from a DC power supply into a power required by a load; an output current detection unit which detects an output current of the power conversion unit; and a temperature detection unit which detects an ambient temperature. Further, the lighting device includes an operation unit which, when calculating an output current command value of the power conversion unit based on the ambient temperature detected by the temperature detection unit, calculates the output current command value so as not to exceed an upper limit of the output current command value set according to a resistance value of an externally connected resistor; and a control unit which controls the power conversion unit such that the output current of the power conversion unit detected by the output current detection unit becomes the output current command value calculated by the operation unit.

In accordance with a third aspect of the present invention, there is provided a lighting device including: a power conversion unit which converts a DC power supplied from a DC power supply into a power required by a load; an output current detection unit which detects an output current of the power conversion unit; and an output voltage detection unit which detects an output voltage of the power conversion unit. Further, the lighting device includes an operation unit which, when calculating an output current command value of the power conversion unit based on the output voltage of the power conversion unit detected by the output voltage detection unit, calculates the output current command value so as not to exceed an upper limit of the output current command value set according to a resistance value of an externally connected resistor; and a control unit which controls the power conversion unit such that the output current of the power conversion unit detected by the output current detection unit becomes the output current command value calculated by the operation unit.

Preferably, the lighting device is a headlamp lighting device, and the load is a headlamp for vehicle.

In accordance with a fourth aspect of the present invention, there is provided a headlamp unit including any one of the lighting devices described above.

In accordance with a fifth aspect of the present invention, there is provided a vehicle including any one of the lighting devices and the headlamp unit which are described above.

BRIEF DESCRIPTION OF THE DRAWINGS

The objects and features of the present invention will become apparent from the following description of embodiments, given in conjunction with the accompanying drawings, in which:

FIGS. 1A and 1B illustrate a headlamp lighting device in accordance with a first embodiment of the present invention, wherein FIG. 1A is a schematic circuit diagram and FIG. 1B is a partial circuit diagram;

DETAILED DESCRIPTION OF THE EMBODIMENTS

Hereinafter, a headlamp lighting device, and headlamp unit and vehicle using the same in accordance with embodiments of the present invention will be described with reference to the accompanying drawings which form a part hereof. In the following description, a headlamp lighting device is described as an example of a lighting device, but the lighting device may be any other lighting device capable of supplying a power to a load without being limited to the headlamp lighting device.

First Embodiment

Figure 1A:
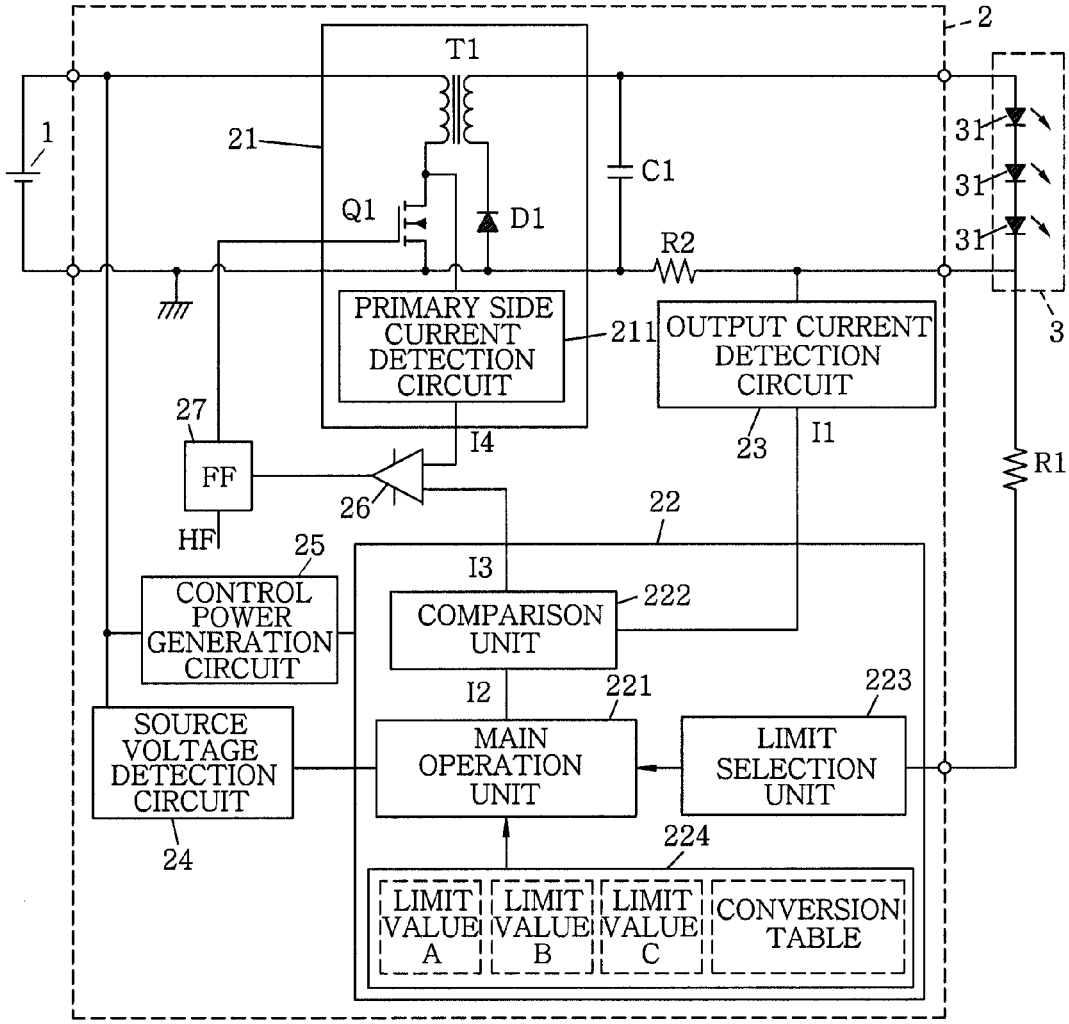

FIG. 1A is a schematic circuit diagram showing an example of a headlamp lighting device 2 in accordance with a first embodiment of the present invention. The headlamp lighting device 2 includes a DC/DC converter 21, an operation circuit 22, an output current detection circuit 23, a source voltage detection circuit 24, a control power generation circuit 25, a comparator 26 and a flip-flop 27.

The DC/DC converter (power conversion unit) 21 includes a transformer T1, a switching element Q1 connected to a primary side of the transformer T1, a diode D1 connected to a secondary side of the transformer T1, and a primary side current detection circuit 211 which detects a current flowing through the primary side of the transformer T1. The DC/DC converter 21 has a function to convert a DC power supplied from a battery (DC power supply) 1 in response to turning on of a LOW beam switch (not shown) into a DC power required by a headlamp (load) 3.

Further, a primary side current I4 detected by the primary side current detection circuit 211 is inputted to the comparator 26. The comparator 26 compares the primary side current I4 with an output current command value I3 applied from the operation circuit 22 and outputs a reset signal to the flip-flop 27 according to the result of comparison. Between output terminals of the DC/DC converter 21, a capacitor C1 for smoothing is connected. If the switching element Q1 is a field-effect transistor (FET), its on-resistance becomes approximately an ohmic resistance. Therefore, a drain voltage of the switching element Q1 may be amplified by the primary side current detection circuit 211 consisting of an operation amplifier and the like, thereby detecting the primary side current I4.

The output current detection circuit (output current detection unit) 23 detects a current (output current of the DC/DC converter 21) I1 flowing through a plurality of (three in FIG. 1A) LEDs 31 constituting the headlamp 3 by using a resistor R2, and outputs the detected output current I1 to the operation circuit 22.

The source voltage detection circuit (source voltage detection unit) 24 detects a source voltage (output voltage) of the battery 1, and outputs the detected source voltage to the operation circuit 22.

The control power generation circuit 25 generates an operating power to the operation circuit 22, the comparator 26 and the flip-flop 27 from the DC power supplied from the battery 1.

The primary side current I4 detected by the primary side current detection circuit 211 of the DC/DC converter 21 and the output current command value I3 applied from the operation circuit 22 are inputted to the comparator 26, and the comparator 26 outputs a reset signal to the flip-flop 27 according to the result of comparison thereof. Specifically, the comparator 26 does not outputs a reset signal if the primary side current I4 is smaller than the output current command value I3, and outputs a reset signal to reset the flip-flop 27 when the primary side current I4 reaches the output current command value I3.

The flip-flop 27 functions as a drive circuit of the switching element Q1 of the DC/DC converter 21, and the switching element Q1 is turned on when the flip-flop 27 is set to a high frequency ON signal HF. When the switching element Q1 is turned on, the primary side current I4 flows through a primary winding of the transformer T1 to store energy in the transformer T1. Then, when the primary side current I4 flowing through the primary winding of the transformer T1 reaches the output current command value I3, the reset signal is outputted from the comparator 26, and the flip-flop 27 is reset to turn off the switching element Q1. When the switching element Q1 is turned off, a counter electromotive force is generated in a secondary winding by the energy stored in the transformer T1 and, accordingly, the capacitor C1 is charged through the diode D1. In this embodiment, the comparator 26 and the flip-flop 27 serve as a control unit.

The operation circuit (operation unit) 22 is formed of, e.g., a microcomputer and includes a main operation unit 221, a comparison unit 222, a limit selection unit 223, and a storage unit 224. A conversion table and limit values A to C to be described later are stored in advance in the storage unit 224.

A voltage signal outputted from the limit selection unit 223 is inputted to the main operation unit 221, and the main operation unit 221 reads from the storage unit 224 one of the limit values A to C according to the voltage signal. Further, the source voltage of the battery 1 detected by the source voltage detection circuit 24 is also inputted to the main operation unit 221, and the main operation unit 221 reads from the storage unit 224 an output current value corresponding to the source voltage based on the conversion table. Further, the main operation unit 221 calculates an output current command value I2 based on the limit values A to C and the output current value. In addition, a specific operation will be described later.

Figure 1B:
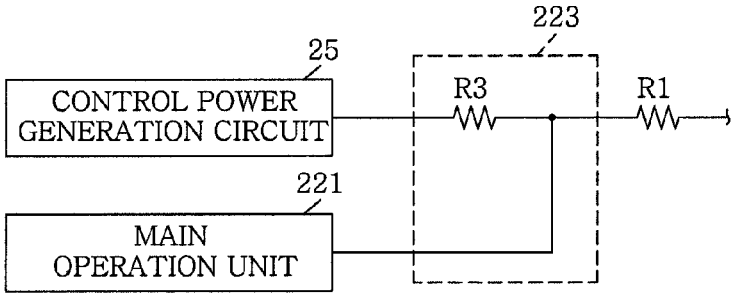

FIG. 1B shows an example of circuit diagram of the limit selection unit 223, which has a resistor R3 connected to an output terminal of the control power generation circuit 25. A voltage (partial voltage) of a connection point of the resistor R3 and the resistor R1 externally connected to a cathode terminal of the headlamp 3 is inputted as the voltage signal to the main operation unit 221. For example, when the output voltage of the control power generation circuit 25 is 5 V and a resistance value of the resistor R3 is 10 kΩ and when the resistor R1 having a resistance value of 10 kΩ is connected, the voltage signal outputted from the limit selection unit 223 becomes 2.5 V.

Further, if both terminals of the resistor R1 are shorted (i.e., corresponding to the resistance value 0 of the resistor R1), the voltage signal outputted from the limit selection unit 223 becomes 0 V. If the connection point between the resistor R1 and the resistor R3 is opened (i.e., corresponding to the resistance value ∞), the voltage signal outputted from the limit selection unit 223 becomes 5 V. Then, the main operation unit 221 reads, from the storage unit 224, the limit value A if the voltage signal inputted from the limit selection unit 223 is 0 V, the limit value B if the voltage signal is 2.5 V, and the limit value C if the voltage signal is 5 V.

Here, it is assumed that a rated current of the LEDs 31 included in the headlamp 3 is 0.7 A, and 0.7 A, 0.69 A and 0.68 A are set as the limit values A to C, respectively. For example, if the LEDs 31 having a luminous flux of high rank are installed to the headlamp lighting device 2, the connection point between the resistor R1 and the resistor R3 is opened in order to suppress the output current of the headlamp lighting device 2 to a low level. Accordingly, the main operation unit 221 reads the limit value C from the storage unit 224.

Further, if the LEDs 31 having a luminous flux of low rank are installed to the headlamp lighting device 2, both terminals of the resistor R1 are shorted in order to increase the output current. The main operation unit 221 reads the limit value A from the storage unit 224. Further, if the LEDs 31 having a luminous flux of middle rank are installed to the headlamp lighting device 2, the resistor R1 having a resistance value of 10 kΩ is connected, and the main operation unit 221 reads the limit value B from the storage unit 224. By selecting one of the limit values A to C according to the rank of the LEDs 31 used in this way, the brightness of each of the LEDs 31 can be set to a predetermined range regardless of the rank of the luminous flux of the LEDs 31.

The output current command value I2 is inputted to the comparison unit 222 from the main operation unit 221 and the output current I1 detected by the output current detection circuit 23 is also inputted to the comparison unit 222. The comparison unit 222 changes the output current command value I3 to make these values equal, and outputs it to the comparator 26.

Figure 2A:
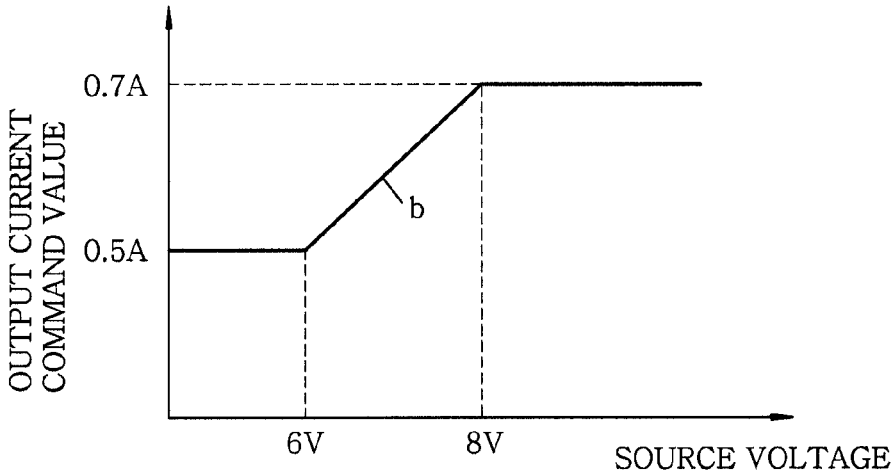
FIGS. 2A to 2C are graphs for explaining an operation of the headlamp lighting device shown in FIGS. 1A and 1B.
Figure 2B:
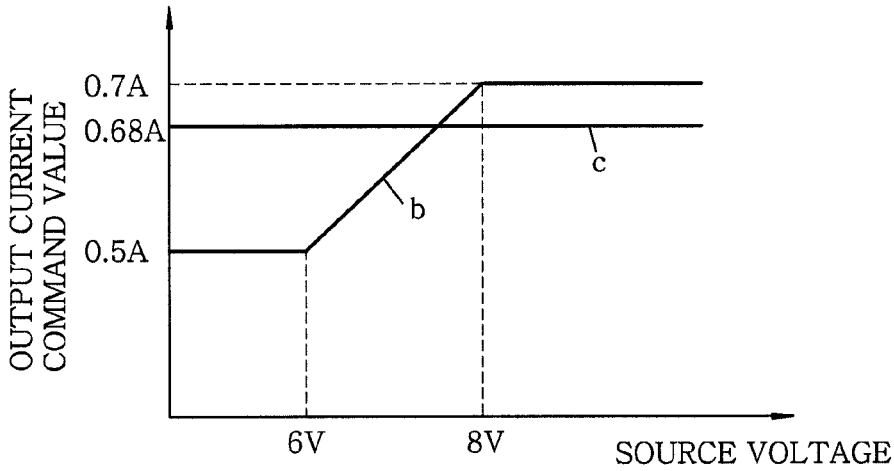
Figure 2C:
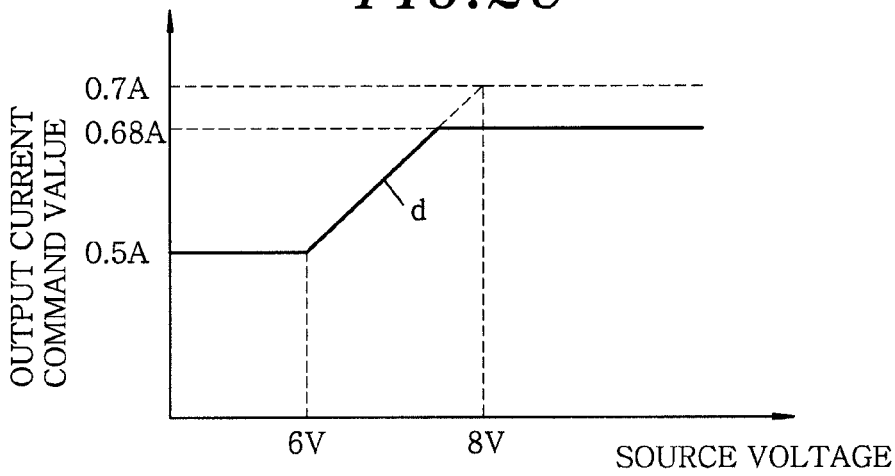

FIG. 2A is a graph showing an example of the conversion table stored in the storage unit 224. As represented by the solid line b in the figure, the output current value is set according to the source voltage of the battery 1. Also in this embodiment, one of the limit values A to C is selected according to the resistance value of the externally connected resistor R1, and the limit value is indicated by the solid line c in FIG. 2B (FIG. 2B shows a case where the limit value is 0.68 A). Then, the main operation unit 221 compares the output current value read from the storage unit 224 based on the conversion table with the selected limit value, and outputs the smaller value as the output current command value I2 to the comparison unit 222 (see the solid line d in FIG. 2C).

In this embodiment, by PWM controlling the ON time of the switching element Q1 of the DC/DC converter 21 using the above circuit configuration, the constant current control of the LEDs 31 can be achieved.

Figure 3:
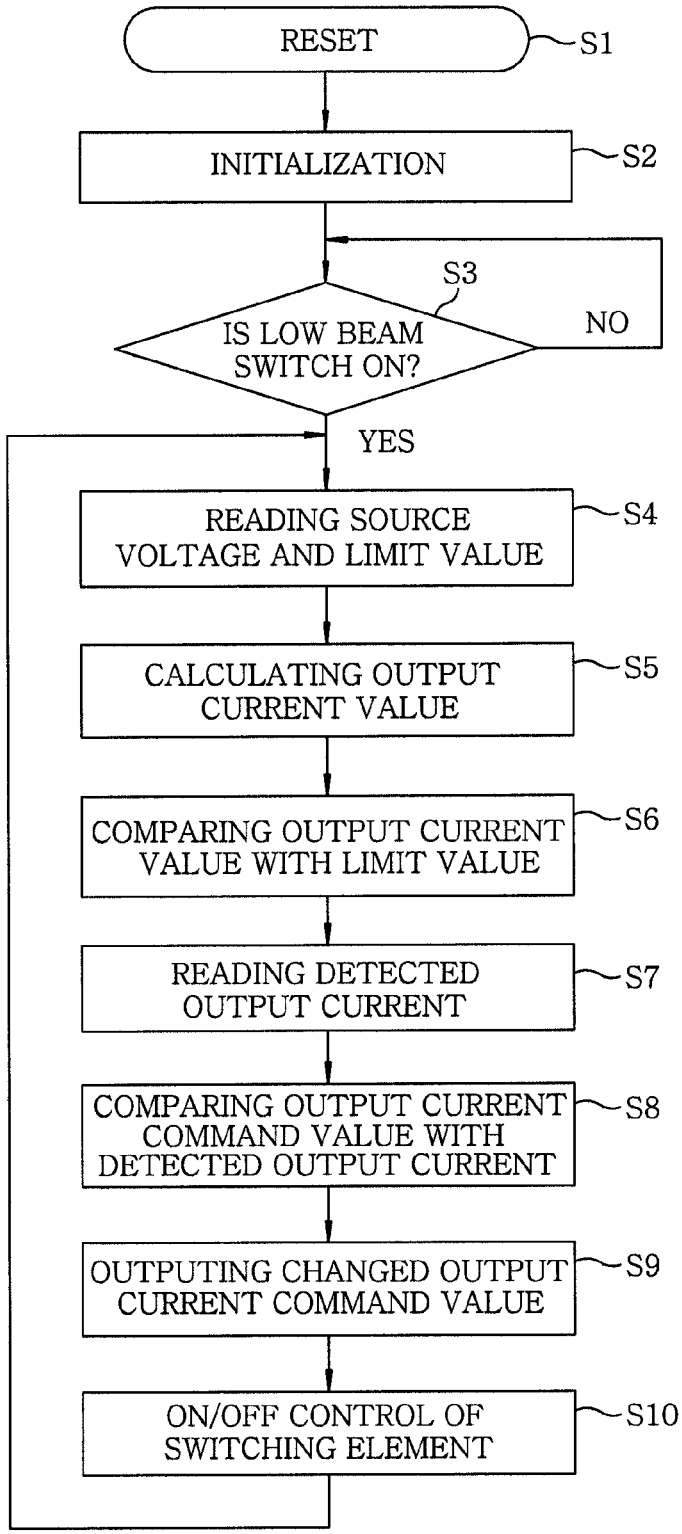
FIG. 3 is a flowchart for explaining the operation of the headlamp lighting device shown in FIGS. 1A and 1B.

Next, an operation of the headlamp lighting device 2 will be described with reference to a flowchart shown in FIG. 3. When the operating power is supplied from the control power generation circuit 25 to the operation circuit 22, the operation circuit 22 is released from the reset and starts the operation (step S1). At first, various initialization processes of the program are performed (step S2). Subsequently, the operation circuit 22 determines whether the LOW beam switch (not shown) is ON or not (step S3).

If it is determined that the LOW beam switch is not ON, the operation does not proceed to step S4 (No of step S3). If it is determined that the LOW beam switch is ON (Yes of step S3), the operation circuit 22 performs A/D conversion on and reads the source voltage of the battery 1 detected by the source voltage detection circuit 24, and inputs it to the main operation unit 221 (step S4). At this time, the main operation unit 221 reads from the storage unit 224 one of the limit values A to C according to the voltage signal inputted from the limit selection unit 223 (step S4).

In addition, the main operation unit 221 calculates the output current value corresponding to the source voltage of the battery 1 based on the conversion table stored in the storage unit 224 (step S5). Then, the main operation unit 221 compares the output current value with the selected limit value, and outputs the smaller value as the output current command value I2 to the comparison unit 222 (step S6). Further, the operation circuit 22 reads the output current I1 detected by the output current detection circuit 23, after performing A/D conversion thereon, and inputs it to the comparison unit 222 (step S7).

The comparison unit 222 compares the output current command value I2 inputted from the main operation unit 221 with the output current I1 (step S8), and changes the output current command value I3 to make these values equal. Then, the comparison unit 222 outputs it to the comparator 26 (step S9). Thus, based on the primary side current I4 and the output current command value I3, on/off control of the switching element Q1 of the DC/DC converter 21 is performed by the comparator 26 and the flip-flop 27 (step S10), thereby executing the constant current control.

Figure 4:
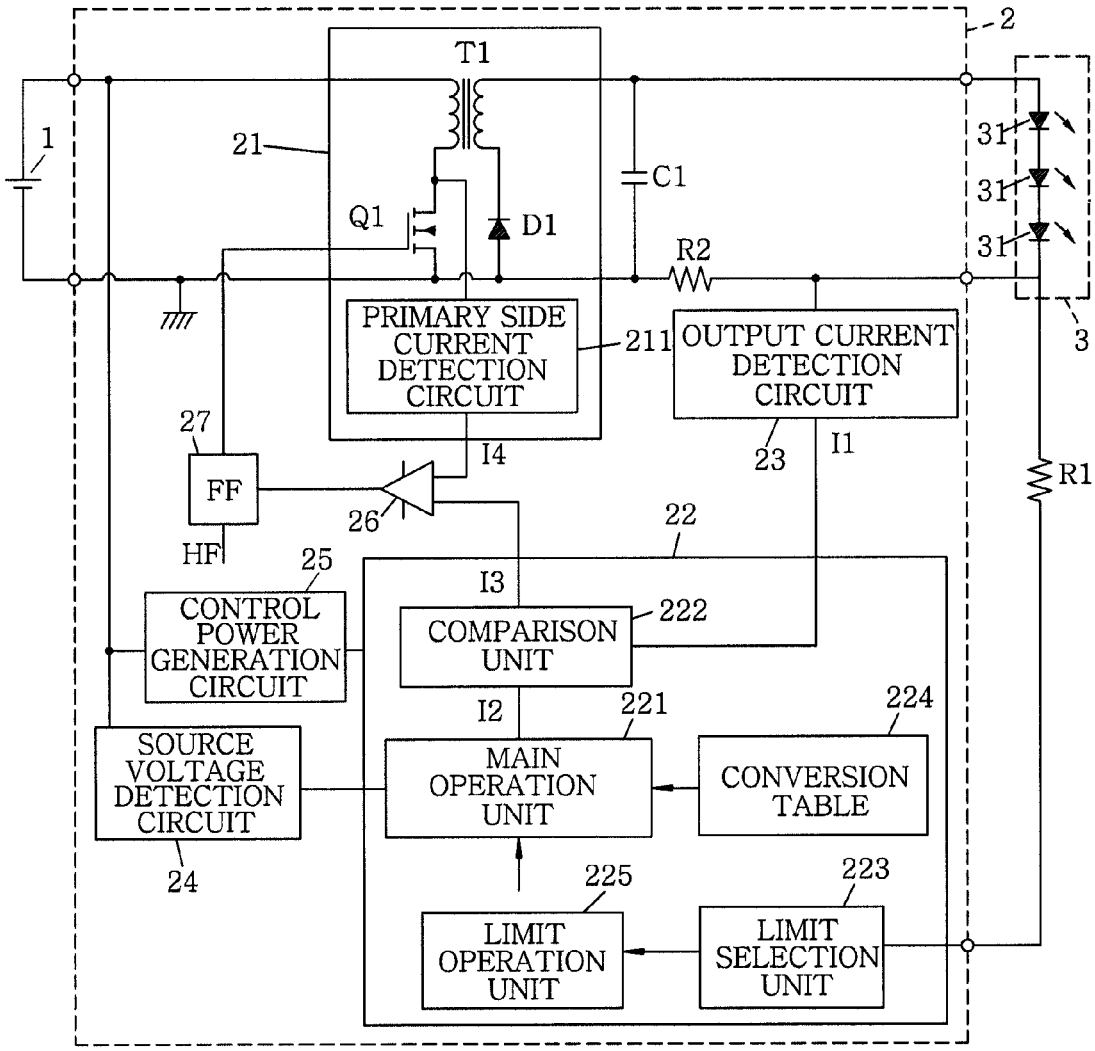
FIG. 4 is a schematic circuit diagram showing another example of the headlamp lighting device shown in FIGS. 1A and 1B.

FIG. 4 is a schematic circuit diagram showing another example of the headlamp lighting device 2 of this embodiment, which is different from the example of FIG. 1A in that a limit operation unit 225 is provided instead of the limit values A to C. In addition, since the other configuration is the same as that of FIG. 1A, the same reference numerals are assigned to the same components, and a description thereof will be omitted. Also, the conversion table is stored in advance in the storage unit 224 as in FIG. 1A.

Figure 5:
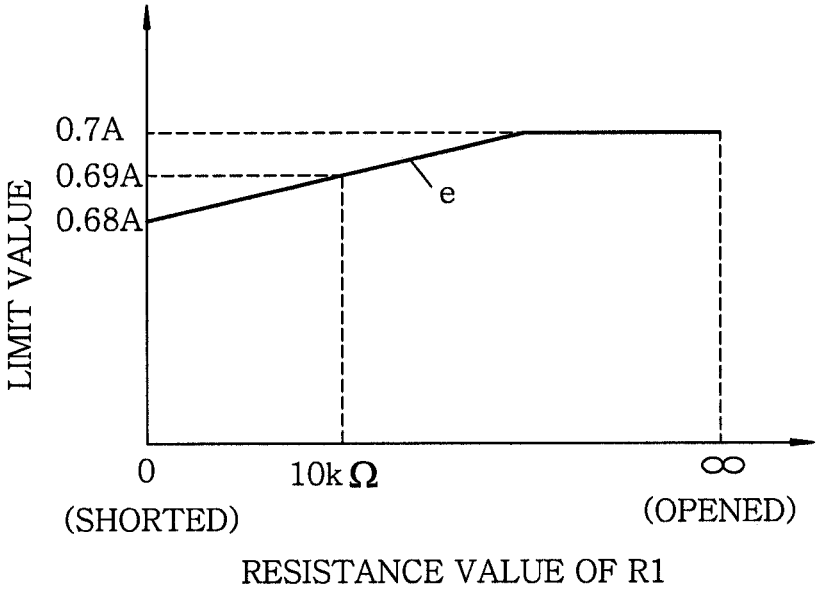
FIG. 5 is a graph for explaining an operation of another example of the headlamp lighting device shown in FIG. 4.

The operation circuit 22 has the limit operation unit 225, and the voltage signal according to the resistance value of the resistor R1 is inputted to the limit operation unit 225 from the limit selection unit 223. Then, the limit value corresponding to the voltage signal is outputted to the main operation unit 221. FIG. 5 is a graph showing the relationship between the resistance value of the resistor R1 and the limit value, and the limit operation unit 225 sets the limit value according to this graph.

Specifically, as represented by the solid line e in FIG. 5, the limit value increase linearly up to 0.7 A from 0.68 A until the resistance value of the resistor R1 reaches a predetermined value greater than 10 kΩ from the state where the both terminals across the resistor R1 are shorted (i.e., resistance value 0). Further, when the resistance value of the resistor R1 is equal to or greater than the predetermined value, the limit value becomes constant to be 0.7 A.

Thus, in the headlamp lighting device 2 in which the output current I1 of the DC/DC converter 21 is limited according to the source voltage of the battery 1, when a change occurs in the number or luminous flux of the LEDs 31, the output current I1 can be adjusted according to the change only by replacing the resistor R1. Therefore, it is possible to simply adjust the output current I1 while reducing the cost. Further, by adjusting the output current I1 of the DC/DC converter 21 for each headlamp lighting device 2, it is possible to reduce a variation in light output between headlamp lighting devices 2. In particular, as shown in FIG. 5, by continuously changing the limit value according to the resistance value of the resistor R1, it is possible to further reduce the variation in light output between headlamp lighting devices.

In addition, a method of determining the limit value described in this embodiment is merely exemplary. For example, if the LEDs 31 delivered from parts manufacturers are divided into ranks in advance according to the luminous flux, limit values are prepared according to the number of ranks, and the limit value may be selected according to the rank of the LEDs 31 to be used. Further, FIG. 5 showing the relationship between the resistance value of the resistor R1 and the limit value which is used in the limit operation unit 225 is merely exemplary, and is preferred in that the limit value can be further finely set. For example, a data table in which the resistance value of the resistor R1 is associated with the limit value may be used. In addition, the relationship of the limit value and the resistance value is not limited to linear characteristics as shown in FIG. 5, and may have characteristics of a curve.

In this embodiment, the output current of the DC/DC converter 21 is reduced, but an average current may be reduced by PWM dimming, and similarly, it is possible to simply adjust the output current while suppressing an increase in cost. In this case, for example, when the LEDs 31 are turned on at a frequency of 100 Hz and its duty is 100% at a normal source voltage, the duty may be reduced down to the limit value at a rate of 2% per minute in case of a low source voltage.

Further, the LEDs 31 and the resistor R1 may be included in the same package. In this case, the resistance value of the resistor R1 is determined according to the rank of the luminous flux of the LEDs 31 included in the same package. In addition, the graphs and the source voltage and output current command value in the graphs that have been described in this embodiment are merely exemplary, and the present invention is not limited thereto.

In this embodiment, a case where the resistance value of the resistor R1 is of three types, i.e., 0, 10 kΩ and ∞ has been described as an example. However, the resistance value of the resistor R1 is not limited to the above and may be selected according to the number of limit values. Further, although the DC/DC converter 21 is used as a power conversion unit in this embodiment, for example, a chopper circuit or the like may be used without being limited to this.

Second Embodiment

Figure 6:
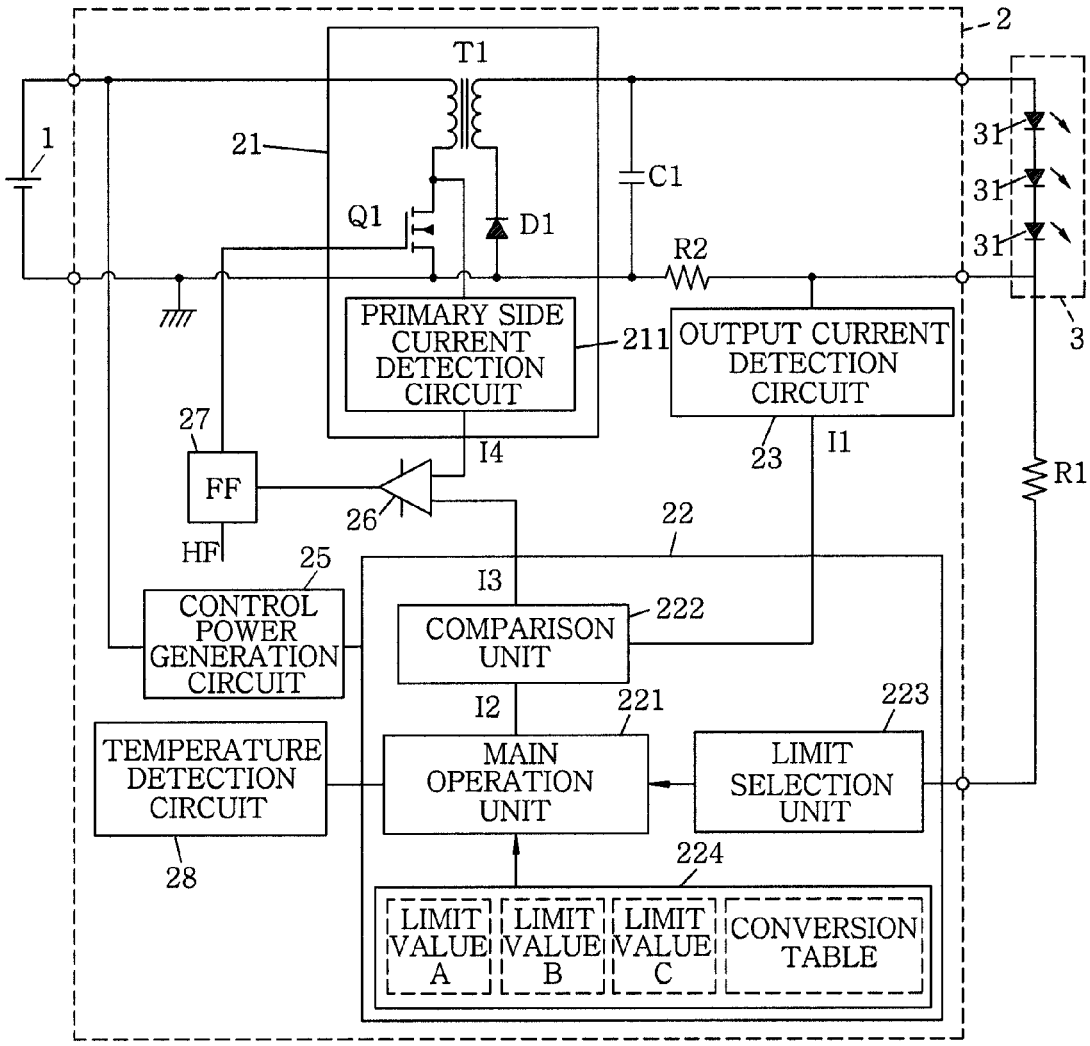
FIG. 6 is a schematic circuit diagram showing a headlamp lighting device in accordance with a second embodiment of the present invention.

A second embodiment of the headlamp lighting device 2 will be described with reference to FIGS. 6 and 7. Although the output current command value of the DC/DC converter 21 is calculated based on the source voltage of the battery 1 in the first embodiment, the output current command value is calculated based on the ambient temperature detected by a temperature detection circuit 28 in the second embodiment. Further, since the other configuration is the same as that of FIG. 1A of the first embodiment, the same reference numerals are assigned to the same components, and a description thereof will be omitted.

The headlamp lighting device 2 of this embodiment includes the DC/DC converter 21, the operation circuit 22, the output current detection circuit 23, the control power generation circuit 25, the comparator 26, the flip-flop 27 and the temperature detection circuit 28 which detects the ambient temperature.

The ambient temperature detected by the temperature detection circuit (temperature detection unit) 28 is inputted to the main operation unit 221 of the operation circuit 22, and the main operation unit 221 calculates the output current command value I2 of the DC/DC converter 21 based on the detected ambient temperature.

Figure 7A:
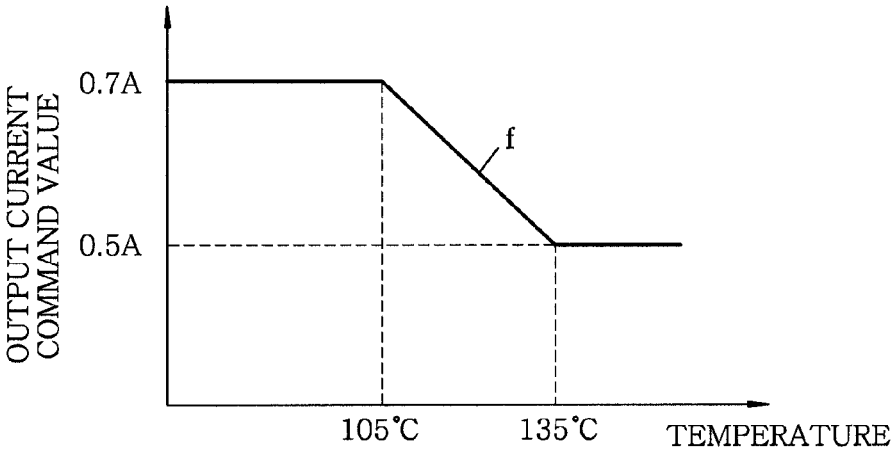
FIGS. 7A to 7C are graphs for explaining an operation of the headlamp lighting device shown in FIG. 6.
Figure 7B:
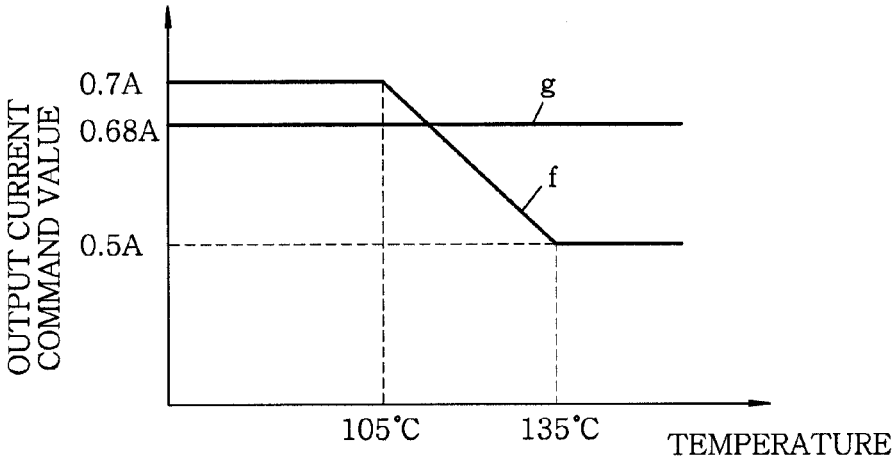

FIG. 7A is a graph showing an example of the conversion table stored in the storage unit 224. As represented by the solid line f in the figure, the output current command value is set according to the ambient temperature. Further, one of the limit values A to C is selected according to the resistance value of the externally connected resistor R1, and the solid line g in FIG. 7B indicates the limit value (the limit value is 0.68 A in FIG. 7B).

Figure 7C:
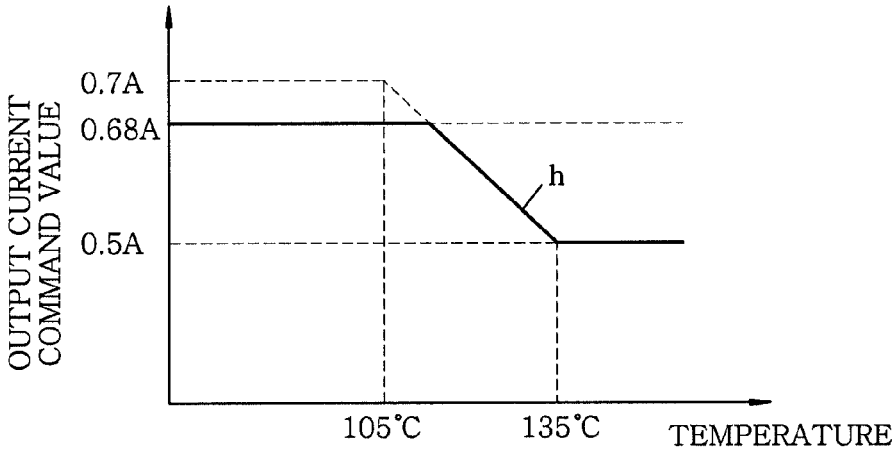

Then, the main operation unit 221 compares the output current value read from the storage unit 224 based on the conversion table with the selected limit value, and outputs the smaller value as the output current command value I2 to the comparison unit 222 (see the solid line h in FIG. 7C). Since the operation of obtaining the output current command value is similar to that of the first embodiment, its description is omitted.

Thus, in the headlamp lighting device 2 in which the output current I1 of the DC/DC converter 21 is limited according to the ambient temperature, the output current I1 can be adjusted according to a change in the number or luminous flux of the LEDs 31 only by replacing the resistor R1. Therefore, it is possible to simply adjust the output current I1 while reducing the cost. In addition, by adjusting the output current I1 of the DC/DC converter 21 for each headlamp lighting device 2, it is possible to reduce a variation in light output between headlamp lighting devices 2.

Also in this embodiment, the limit operation unit may be provided instead of the limit values A to C stored in the storage unit 224. Similarly, it is possible to simply adjust the output current I1 while suppressing an increase in cost.

Third Embodiment

Figure 8:
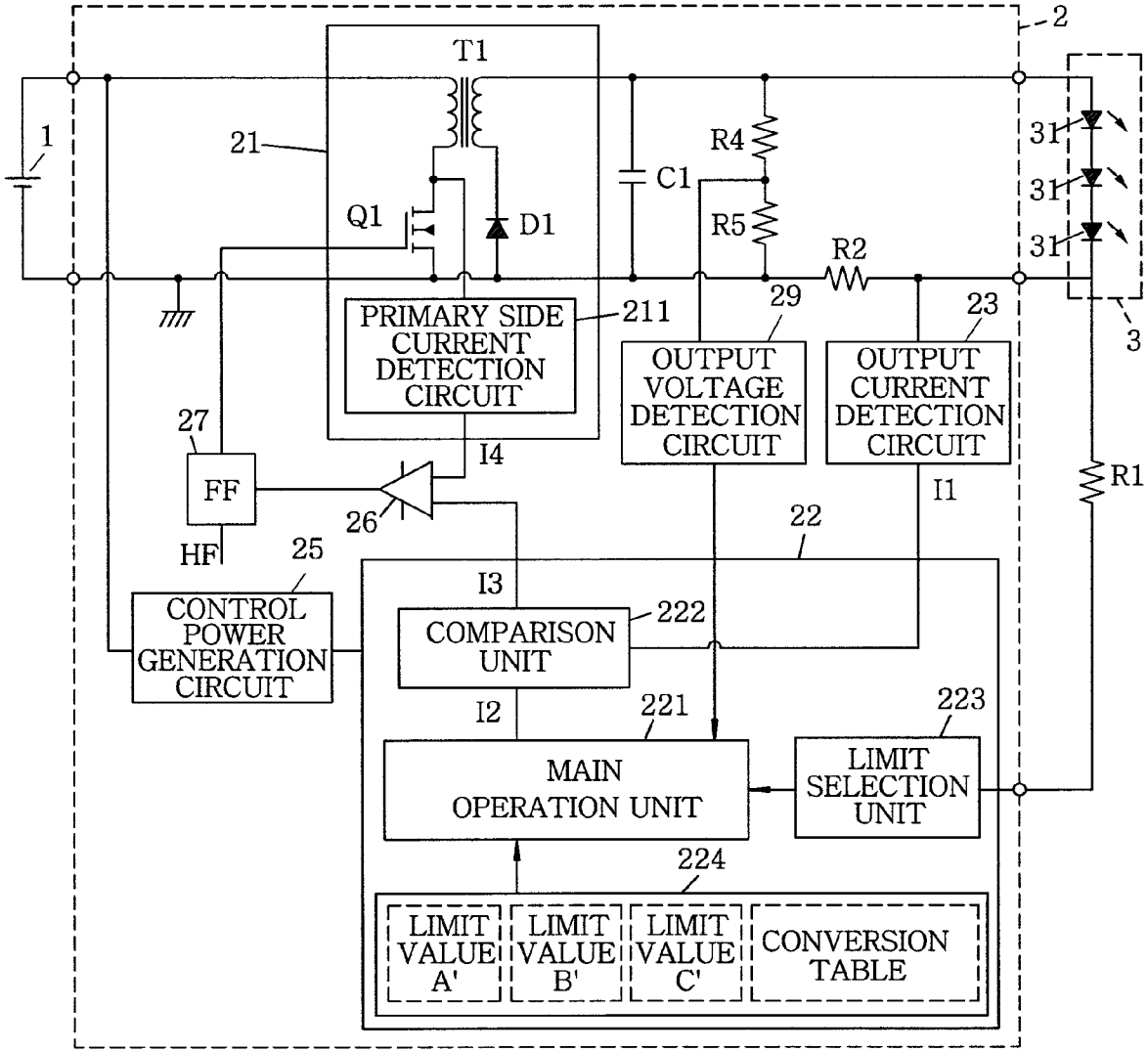
FIG. 8 is a schematic circuit diagram illustrating a headlamp lighting device in accordance with a third embodiment of the present invention.

A third embodiment of the headlamp lighting device 2 will be described with reference to FIGS. 8 and 9. Although the output current command value of the DC/DC converter 21 is calculated based on the source voltage of the battery 1 in the first embodiment, the output current command value is calculated based on an output voltage of the DC/DC converter 21 in the third embodiment. Since the other configuration is the same as that of FIG. 1A of the first embodiment, the same reference numerals are assigned to the same components, and a description thereof will be omitted.

The headlamp lighting device 2 of this embodiment includes the DC/DC converter 21, the operation circuit 22, the output current detection circuit 23, the control power generation circuit 25, the comparator 26, the flip-flop 27 and an output voltage detection circuit 29 which detects the output voltage of the DC/DC converter 21.

The output voltage of the DC/DC converter 21 detected by the output voltage detection circuit (output voltage detection unit) 29 is inputted to the main operation unit 221 of the operation circuit 22, and the main operation unit 221 calculates the output current command value I2 of the DC/DC converter 21 based on the detected output voltage. In this embodiment, a voltage (partial voltage) of a connection point of resistors R4 and R5 connected between the output terminals of the DC/DC converter 21 is detected as the output voltage.

Figure 9A:
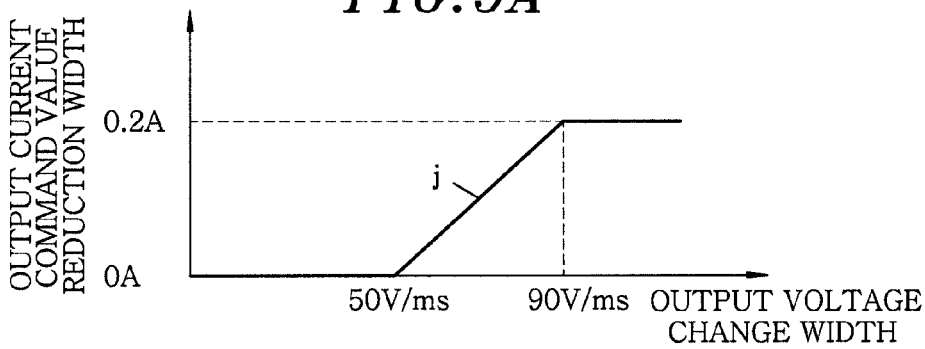
FIGS. 9A to 9D are graphs for explaining an operation of the headlamp lighting device shown in FIG. 7.
Figure 9B:
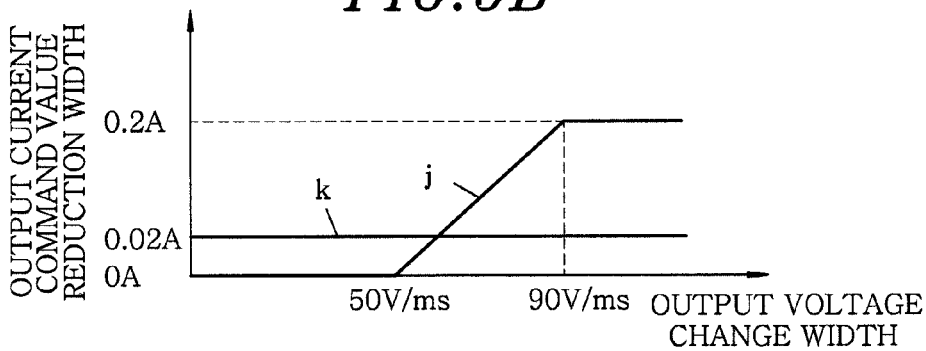

FIG. 9A is a graph showing an example of the conversion table stored in the storage unit 224. As represented by the solid line j in the figure, a reduction width of the output current command value is set according to a change width in the output voltage of the DC/DC converter 21. Also in this embodiment, one of the limit values A to C of the current reduction width is selected according to the resistance value of the externally connected resistor R1, and the solid line k in FIG. 9B indicates the limit value of the current reduction width (e.g., 0.02 A in FIG. 9B). The limit values A to C are set, for example, such that the reduction width increases as the luminous flux increases.

Figure 9C:
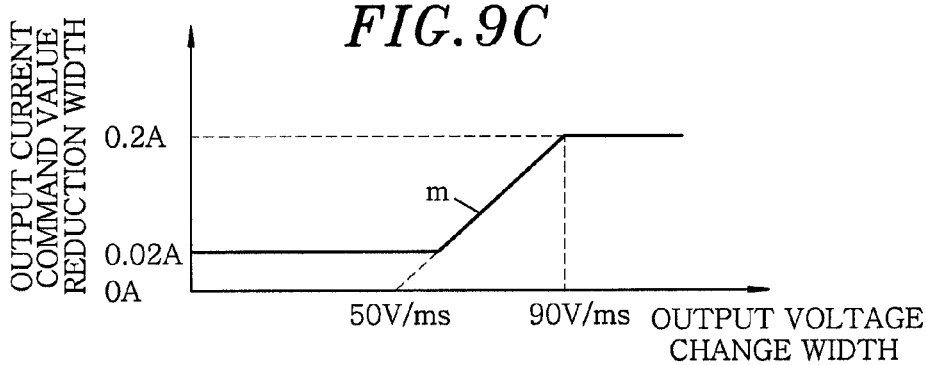
Figure 9D:
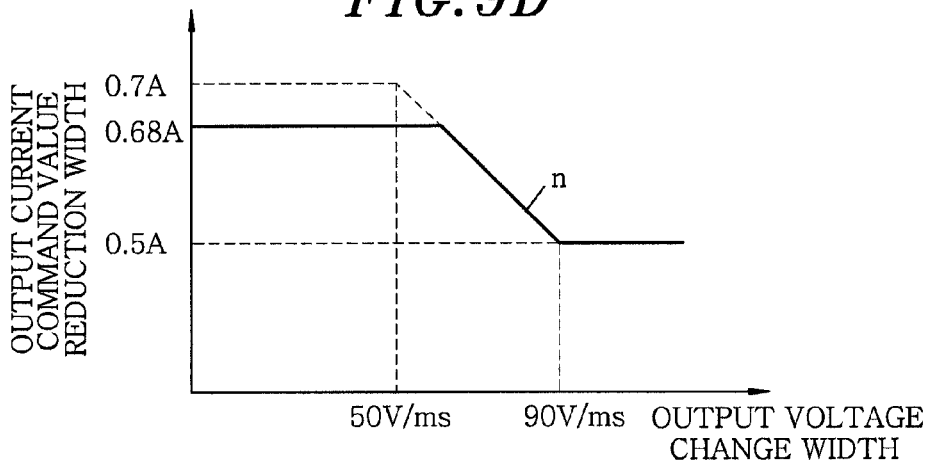

Then, the main operation unit 221 compares the reduction width of the output current value read from the storage unit 224 based on the conversion table with the selected limit value of the current reduction width, and selects the larger value as the reduction width of the output current command value (see solid line m in FIG. 9C). As a result, the main operation unit 221 calculates the output current command value I2 according to the solid line n in FIG. 9D. In addition, since the other operation is similar to that of the first embodiment, its description is omitted.

Thus, in the headlamp lighting device 2 in which the output current I1 of the DC/DC converter 21 is limited according to the output voltage of the DC/DC converter 21, the output current I1 can be adjusted according to a change in the number or luminous flux of the LEDs 31 only by replacing the resistor R1. Therefore, it is possible to simply adjust the output current I1 while reducing the cost. In addition, by adjusting the output current I1 of the DC/DC converter 21 for each headlamp lighting device 2, it is possible to reduce a variation in light output between headlamp lighting devices 2.

Also in this embodiment, the limit operation unit may be provided instead of the limit values A to C stored in the storage unit 224. Similarly, it is possible to simply adjust the output current I1 while suppressing an increase in cost.

Fourth Embodiment

An embodiment of a headlamp and vehicle using the headlamp lighting device 2 described in the first to third embodiments will be described with reference to FIG. 10.

Figure 10:
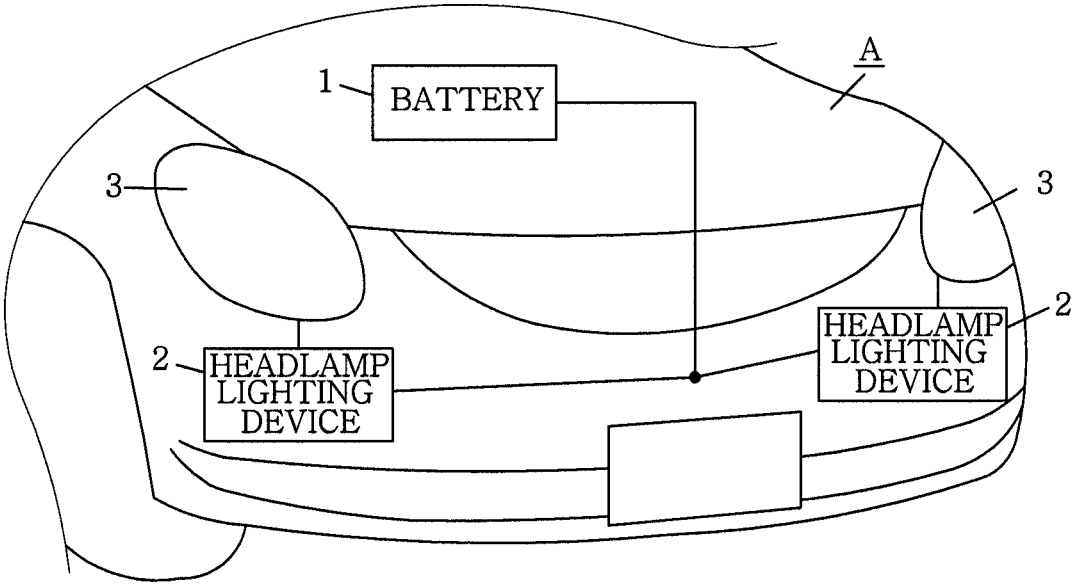
FIG. 10 is a diagram showing a partial appearance of a vehicle in accordance with a fourth embodiment of the present invention.

FIG. 10 partially shows an appearance of vehicle A in accordance with this embodiment. The vehicle A includes a pair of headlamps 3 arranged on both sides of the vehicle in its width direction, and a pair of headlamp lighting devices 2 each supplying a predetermined lighting power to each of the headlamps 3.

In this embodiment, by using the headlamp lighting device 2 described in the first to third embodiments, for example, even if there is a difference in the luminous flux of the LEDs 31 constituting the headlamps 3 on the right and left, the light output of the headlamps 3 on both sides can be set to a predetermined range by adjusting the resistance value of the externally connected resistor R1. That is, according to this embodiment, by using the headlamp lighting device 2 described in the first to third embodiments, it is possible to provide a headlamp unit and the vehicle A capable of simply adjusting the output current of the DC/DC converter 21 while reducing the cost. Further, in case of using the headlamp lighting device 2 of the second embodiment, the circuit can be prevented from being broken due to temperature rise, and the vehicle A capable of stably turning on the headlamps 3 can be achieved.

While the invention has been shown and described with respect to the embodiments, it will be understood by those skilled in the art that various changes and modification may be made without departing from the scope of the invention as defined in the following claims.

What is claimed is:

1. A lighting device comprising:

a power conversion unit which converts a direct current (DC) power supplied from a DC power supply into a power required by a load;

an output current detection unit which detects an output current of the power conversion unit;

a source voltage detection unit which detects a source voltage of the DC power supply;

an operation unit which, when calculating an output current command value of the power conversion unit based on a voltage value detected by the source voltage detection unit, calculates the output current command value so as not to exceed an upper limit of the output current command value set according to a resistance value of an externally connected resistor; and a control unit which controls the power conversion unit such that the output current of the power conversion unit detected by the output current detection unit becomes the output current command value calculated by the operation unit.

2. The lighting device of claim 1, wherein the lighting device is a headlamp lighting device, and the load is a headlamp for vehicle.

3. A headlamp unit comprising:

the lighting device described in claim 1.

4. A vehicle comprising:

the lighting device described in claim 1.

5. A vehicle comprising:

the headlamp unit described in claim 3.

6. A lighting device comprising:

a power conversion unit which converts a DC power supplied from a DC power supply into a power required by a load;

an output current detection unit which detects an output current of the power conversion unit;

a temperature detection unit which detects an ambient temperature;

an operation unit which, when calculating an output current command value of the power conversion unit based on the ambient temperature detected by the temperature detection unit, calculates the output current command value so as not to exceed an upper limit of the output current command value set according to a resistance value of an externally connected resistor; and a control unit which controls the power conversion unit such that the output current of the power conversion unit detected by the output current detection unit becomes the output current command value calculated by the operation unit.

7. The lighting device of claim 6, wherein the lighting device is a headlamp lighting device, and the load is a headlamp for vehicle.

8. A headlamp unit comprising:

the lighting device described in claim 6.

9. A vehicle comprising:

the lighting device described in claim 6.

10. A vehicle comprising:

the headlamp unit described in claim 8.

11. A lighting device comprising:

a power conversion unit which converts a DC power supplied from a DC power supply into a power required by a load;

an output current detection unit which detects an output current of the power conversion unit;

an output voltage detection unit which detects an output voltage of the power conversion unit;

an operation unit which, when calculating an output current command value of the power conversion unit based on the output voltage of the power conversion unit detected by the output voltage detection unit, calculates the output current command value so as not to exceed an upper limit of the output current command value set according to a resistance value of an externally connected resistor; and a control unit which controls the power conversion unit such that the output current of the power conversion unit detected by the output current detection unit becomes the output current command value calculated by the operation unit.

12. The lighting device of claim 11, wherein the lighting device is a headlamp lighting device, and the load is a headlamp for vehicle.

13. A headlamp unit comprising:

the lighting device described in claim 11.

14. A vehicle comprising:

the lighting device described in claim 11.

15. A vehicle comprising:

the headlamp unit described in claim 13.

* * * * *